United States Patent [19]

Saguchi et al.

[11] 4,339,685

[45] Jul. 13, 1982

[54] SEALED BEAM LAMP ASSEMBLY

[75] Inventors: Norio Saguchi; Hideki Ishii; Yoshiaki Sakakibara; Masakazu Nagasawa; Osami Saitoh; Yukio Wakimizu; Susumu Kanematsu, all of Shimizu, Japan

[73] Assignee: Koito Manufacturing Company, Ltd., Tokyo, Japan

[21] Appl. No.: 148,180

[22] Filed: May 9, 1980

[30] Foreign Application Priority Data

| | | | |
|---|---|---|---|
| May 14, 1979 | [JP] | Japan | 54-63946[U] |
| Dec. 29, 1979 | [JP] | Japan | 54-178457[U] |
| Dec. 29, 1979 | [JP] | Japan | 54-182823[U] |
| Mar. 19, 1980 | [JP] | Japan | 55-34913 |

[51] Int. Cl.[3] ..... H01K 1/28; H01K 1/44

[52] U.S. Cl. ..... 313/113; 313/25; 313/318

[58] Field of Search ..... 313/113, 318, 222, 115, 313/25; 362/267 (U.S. only)

[56] References Cited

U.S. PATENT DOCUMENTS

| | | | |
|---|---|---|---|
| 3,364,378 | 1/1968 | Beesley | 313/222 X |
| 3,678,260 | 7/1972 | Beal | 362/267 |
| 3,904,904 | 9/1975 | Meinecke et al. | 313/113 |
| 4,195,245 | 3/1980 | Miyazawa | 313/113 |
| 4,241,391 | 12/1980 | Pitkjaan et al. | 313/222 X |
| 4,262,228 | 4/1981 | Cruse | 313/113 X |

*Primary Examiner*—Palmer C. Demeo

*Attorney, Agent, or Firm*—George B. Oujevolk

[57] ABSTRACT

A sealed beam lamp assembly, suitable for use as a motor vehicle headlight, has an incandescent lamp mounted within an inert-gas-filled, molded-glass housing integrally comprising a reflector and a control-lens cover. For supporting the lamp in position within the housing, a metal-made support rod extends forwardly from one of ferrules on the reflector and has its front end preformed into the shape of a U to provide a rearwardly directed fold. Welded to this fold of the support rod is a metal band rigidly encircling the base of the lamp. The lamp position relative to the reflector is therefore adjustable as required by manually turning the fold of the support rod about its main straight portion. The support rod serves also to provide electrical connection between the ferrule and one of the lamp leads.

6 Claims, 10 Drawing Figures

SEALED BEAM LAMP ASSEMBLY

BACKGROUND OF THE INVENTION

Our invention relates to electric lamps in general and, in particular, to electric lamp assemblies comprising a lamp or light bulb and a reflector. More particularly our invention deals with improved means for mounting the lamp in position on the reflector in such a lamp assembly. The improved means of our invention have particular utility in conjunction with sealed beam lamp assemblies, having an incandescent lamp such as a halogen lamp mounted within a molded-glass housing, suitable for use as automotive headlamps or headlights.

As is well known, the halogen lamp is a type of incandescent lamp utilizing a halogen regenerative cycle for the longer life of its filament or filaments. On the strengths of its greater durability and higher luminous efficacy the halogen lamp is finding ever-increasing use as the light sources of automotive headlamps and similar lighting installations. A problem occurs in such applications of the halogen lamp, however, because of the fact that the filaments of commercially available halogen lamps do not necessarily lie in correct positions within the lamp bulbs or envelopes.

Let us consider, as an illustration of the problem, a typical sealed beam hardlamp assembly in which a halogen lamp is mounted within an inert-gas-filled, molded-glass housing. The lamp housing comprises a reflector and a control-lens cover, which are sealed together after the lamp is mounted in position on the reflector. It has been known to mount the lamp on the reflector via a straight, metal-made support rod. Rigidly anchored at one end to one of the ferrules on the back of the reflector, and support rod extends forwardly from the reflector and has its front end spot-welded to a metal band tightly wrapped around the base of the lamp. The support rod serves also as an electrical connection between the ferrule and one of the lamp leads.

As has been mentioned, the filament or filaments of the halogen lamp may be displaced from the proper position relative to the bulb. In this case the correct positioning of the bulb itself on the reflector results in the misplacement of the filament or filaments relative to the reflector. The bulb must therefore be amounted suitably displaced on the reflector for the proper positioning of the filament or filaments.

The conventional practice to this end has been to bend the support rod in situ, usually at two different points in the middle of the rod. The following two methods have been known for bending the support rod:

1. The "cold bending" method in which the support rod is bent at room temperature.
2. The "hot bending" method in which the support rod is bent while being heated.

The cold bending method gives rise to springback, that is, the gradual return of the support rod to its original straight shape. Consequently the filament or filaments of the lamp supported by the support rod also undergo gradual displacement from the proper position relative to the reflector.

Such springback of the support rod will not occur if it is bent by the hot bending method. This process requires, however, the use of a heater devised exclusively for that purpose and involves a troublesome, time-consuming operation. Another known practice, alternative to the hot bending method, has been to bend the support rod through greater angles than are required for the proper positioning of the lamp filaments at the moment, to compensate for its springback. An objection to this practice is the difficulty of accurate compensation for springback.

Whichever method is employed, the bending of the support rod at two spaced midpoints thereon is subject to the additional objection that the support rod allows oscillations of the lamp about its bent points during the travel of the vehicle. Such complex oscillations or vibrations of the lamp result in the flickering of the beam thrown thereby, with the consequent danger of dazzling the drivers of oncoming vehicles.

SUMMARY OF THE INVENTION

In view of the noted objections to the prior art our invention seeks to provide an improved electric lamp assembly comprising at least a lamp and a reflector. In order to mount the lamp in position on the reflector there is provided a support rod rigidly anchored at one end to the reflector and generally extending forwardly therefrom. The support rod has its front end portion preformed to include a fold bent upon itself, and this preformed fold is welded or otherwise secured to the lamp for supporting same.

Preferably the front end portion of the support rod is preformed into a U-shaped bend, with the fold disposed in parallel spaced relationship to the shank or unbent portion of the rod. Further, in some preferable embodiments of our invention, the support rod is secured to the lamp via a lamp holder in the form of a metal band tightly encircling the base of the lamp. The lamp holder has a fin extending upwardly from the lamp base, and to this fin is welded the fold of the support rod.

Thus, for adjusting the position of the lamp relative to the reflector, the preformed front end fold of the support rod may be simply turned or twisted about its shank before welding the fold to the lamp holder fin. There is no need for heating the support rod, nor is there any possibility of the twisted support rod springing back to any appreciable degree. It is therefore extremely easy to mount the lamp in position on the reflector. Moreover, once mounted in position, the lamp will not be displaced, both immediately thereafter and during the subsequent period of use of the lamp assembly.

The lamp assembly in accordance with our invention typically takes the form of a sealed beam headlamp assembly for motor vehicles. A particular advantage in this application is that since the support rod is not bent in its middle, the lamp will not dazzle the drivers of oncoming vehicles by making such complex vibrations or oscillations as in the case of the prior art. Our invention also helps to prevent the breakage of the lamp filament or filaments due to excessive vibrations of the lamp.

The above and other features and advantages of our invention, and the invention itself, will become more apparent from a study of the following description of some preferable embodiments, in which reference is directed to the attached drawings.

DESCRIPTION OF THE PREFERRED EMBODIMENTS

Figure 1:
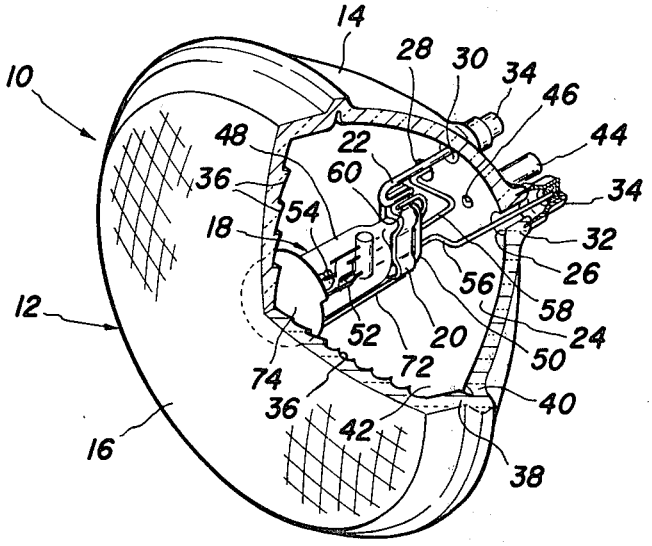
FIG. 1 is a perspective view of a sealed beam headlamp assembly incorporating the novel concepts of our invention, the view showing the glass housing of the headlamp assembly sectioned in two orthogonal planes to reveal the inner details.

We will now describe our invention as adapted specifically for a sealed beam headlamp assembly for particular use on motor vehicles. With reference to FIG. 1 in particular the automotive head-lamp assembly illustrated therein and generally designated 10, broadly comprises:

1. A hermetically sealed, hard-glass lamp housing 12 integrally including a reflector 14 and a molded control-lens cover 16.
2. A dual-filament halogen lamp 18 disposed within the lamp housing 12.
3. A lamp holder 20 of electrically conducting material, usually metal, rigidly holding the halogen lamp 18.
4. A support rod or pin 22, also of metal, mechanically and electrically connecting the lamp holder 20 to the reflector 14 and serving principally to support the halogen lamp 18 in a desired position within the lamp housing 12.

The reflector 14 of the lamp housing 12 is substantially conical or hemispherical in shape. Its inside or front surface 24 is rendered reflective as by vapor deposition of aluminum on the hard glass of which the reflector is molded. For use with the dual-filament halogen lamp 18 the reflector 14 has three ferrule holes 26, 28 and 30 formed approximately centrally therein. Each ferrule hole extends through a ferrule boss 32 projecting rearwardly from the outside surface of the reflector 14. Affixed to each ferrule boss 32 is a ferrule 34 in the form of a hollow, stepped metal cylinder closed at one end, its open end being embedded in the ferrule boss. The three ferrules 34 (two seen in FIG. 1) function to electrically connect the halogen lamp 18 to external electric power circuitry (not shown).

Molded of hard glass having approximately the same coefficient of expansion as that of the reflector 14, the cover 16 integrally includes a plurality of concentric control lens elements 36. The control-lens cover 16 includes a flange 38 which is fused onto the corresponding flange 40 of the reflector 14 after the halogen lamp 18 is mounted in position on the reflector in the manner hereinafter set forth. When reflector 14 and cover 16 are thus joined to provide the lamp housing 12, they define in combination a sealed lamp chamber 42 accommodating the halogen lamp 18. The reflector 14 is formed integral with a gas pipe 44 for introduction of an inert gas into the lamp chamber 42 through a port 46 formed adjacent the ferrule holes 26, 28 and 30.

The principal components of the halogen lamp 18 are:

1. A bulb or envelope 48 having a flat base 50 formed by pinch-sealing the open end of the bulb.
2. A first coiled filament 52 which, upon passage of an electric current therethrough, produces the so-called "upper beam" intended primarily for distant illumination when the vehicle is not meeting or following other vehicles.
3. A second coiled filament 54 for producing the so-called "lower beam" intended to illuminate the road ahead of the vehicle when same is meeting or following another vehicle.

The first 52 and the second 54 coiled filaments will hereinafter be referred to as the upper beam filament and the lower beam filament respectively. As will be seen also from FIG. 2, the halogen lamp 18 further has the following three lead wires extending outwardly from the base 50 of its bulb 48:

1. The common lead 56 connected both to one extremity of the upper beam filament 52 and to one extremity of the lower beam filament 54.
2. The upper beam lead 58 connected to the other extremity of the upper beam filament 52.
3. The lower beam lead 60 connected to the other extremity of the lower beam filament 54.

The common 56 and the upper beam 58 lead wires are suitably bent, as shown in FIG. 1, and inserted into the respective ferrule holes 26 and 28. Projecting into the ferrules 34 through the ferrule holes 26 and 28, the lead wires 56 and 58 are soldered, preferably hard-soldered or brazed, to the respective ferrules. Said one extremity of the upper beam filament 52, said one extremity of the lower beam filament 54, and said other extremity of the upper beam filament 52, are thus electrically connected to the ferrules 34 associated with the ferrule holes 26 and 28. The lower beam lead wire 60 is connected to the lamp holder 20, as will be detailed presently.

Figure 2:
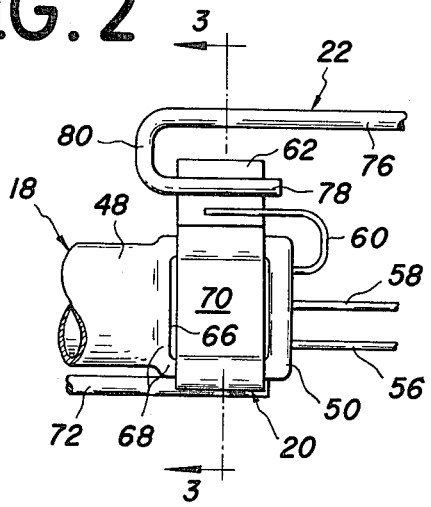
FIG. 2 is an enlarged, fragmentary, side elevational view showing in particular the lamp, lamp holder, and support rod in the headlamp assembly of FIG. 1.
Figure 3:
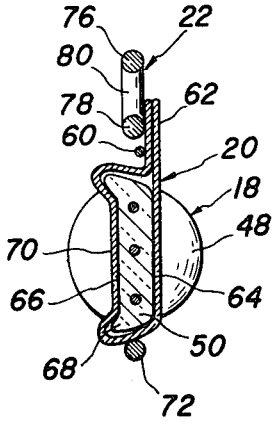
FIG. 3 is a vertical sectional view taken along the line 3—3 of FIG. 2.

With reference to both FIGS. 2 and 3 the lamp holder 20 takes the form of a metal band rigidly surrounding the flat base 50 of the halogen lamp 18. The opposite end portions of the band-shaped lamp holder 20 are held against, and spot-welded to, each other to provide a fin 62 extending upwardly from the lamp base 50. One side 64 of the lamp base 50 is flat, whereas the other side of the lamp base has formed therein a depression 66 which is bounded on all sides by relatively raised rims or undepressed portion 68 of the lamp base.

The lamp holder 20 has formed therein a corresponding depression 70 to fit relatively closely in the lamp base depression 66. Thus the lamp holder 20 positively holds the halogen lamp 18 against any possibility of its accidental displacement or dislodgement. As desired or required, depressions may be formed on both sides of the lamp base 50 and, of course, on both sides of the lamp holder 20. It is also possible to provide a plurality of depressions on each or either side of the lamp base and of the lamp holder.

The noted lower beam lead wire 60 is bent forwardly and spot-welded to the fin 62 of the lamp holder 20. The lower beam lead wire could, however, be so welded to any convenient part of the lamp holder 20. Also spot-welded to the lamp holder 20 is a cap support rod 72 extending forwardly therefrom under the halogen lamp bulb 48. The front end of the cap support rod 72 is spot-welded to a light-shielding cap 74 enclosing the front end of the halogen lamp bulb 48.

Inserted into the ferrule hole 30 in the reflector 14, the rear end of the support rod 22 is hard-soldered to one of the ferrules 34. The support rod 22 is thus electrically connected to the ferrule 34 and further mechanically rigidly anchored to the reflector 14. The support rod 22 extends forwardly from the reflector 14, parallel to its axis, and has its front end portion preformed into the shape of a U. The support rod 22 can therefore be thought of as comprising a shank or unbent portion 76 extending forwardly from the reflector 14, a fold 78 extending rearwardly in parallel spaced relationship to the shank, and a bight 80 serving to connect the shank and the fold. In this particular embodiment the fold 78 underlies the shank 76; that is, the fold lies on that side of the shank which is closer to the halogen lamp 18.

The fold 78 of the support rod 22 is rigidly connected to the fin 62 of the lamp holder 20 for supporting the halogen lamp 18 within the lamp housing 12. The support rod 22 serves also to provide electrical connection between the lower beam lead wire 60 and the ferrule 34 associated with the ferrule hole 30.

In the manufacture of the sealed beam headlamp assembly 10 the support rod fold 78 may be spot-welded to the lamp holder fin 62 so as to hold the halogen lamp filaments 52 and 54 in prescribed positions with respect to the reflector 14. Thereafter the control-lens cover 16 may be fused onto the reflector 14 to form the lamp housing 12. The next step is the substitution, through the gas pipe 44, of a desired inert gas for the air entrapped in the lamp chamber 42. The sealed beam headlamp assembly 10 can be completed as then, with the port 46 closed, the gas pipe 44 is chipped off the reflector 14.

Figure 4A:
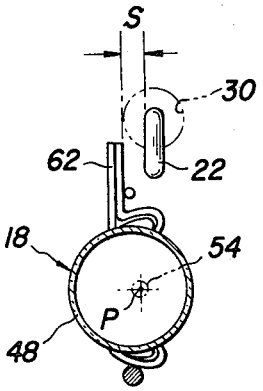
FIG. 4A is a view explanatory of the relative positions of the lamp holder and the support rod, before they are welded together, in the case where the filaments of the lamp are disposed eccentrically within the lamp bulb, the view showing the parts as seen from the left side of FIG. 2.
Figure 4B:
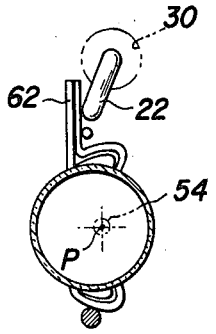
FIG. 4B is a view similar to FIG. 4A except that the lamp holder and the support rod are shown welded together, with the lamp disposed in position within the housing of FIG. 1.

Let it be assumed that the lower beam filament 54 of the halogen lamp 18 is offset laterally from the axis of the bulb 48 as shown in FIG. 4A. If this lower beam filament is disposed in the prescribed position p with respect to the reflector 14, a spacing s will exist between support rod 22 and lamp holder fin 62. The fold 78 and bight 80 of the support rod 22 may then be turned or twisted in a clockwise direction, as viewed in FIG. 4A, about its shank 76 until the support rod fold 78 comes into abutment against the lamp holder fin 62, as pictured in FIG. 4B. The support rod fold 78 can then be spot-welded to the lamp holder fin 62.

It is unnecessary to heat the support rod 22 in twisting same, as in the conventional hot bending operation. Our invention also overcomes the springback of the support rod, which has been the problem with the conventional cold bending operation. Further, since the halogen lamp 18 is positively engaged by the lamp holder 20, the lamp will hardly undergo displacement or dislodgement throughout the lifetime of the sealed beam headlamp assembly 10.

Figure 5:
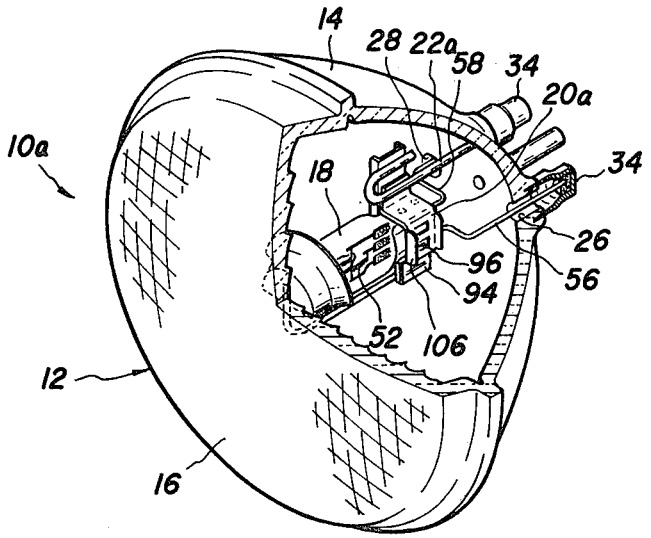
FIG. 5 is a view similar to FIG. 1 but showing another preferred form of sealed beam headlamp assembly in accordance with our invention.
Figure 7:
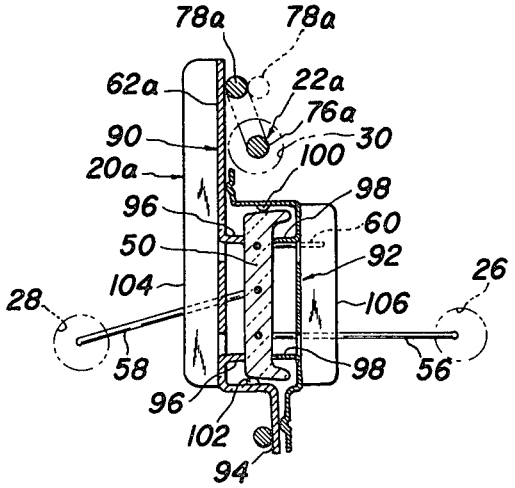
FIG. 7 is a vertical sectional view taken along the line 7—7 of FIG. 6.
Figure 6:
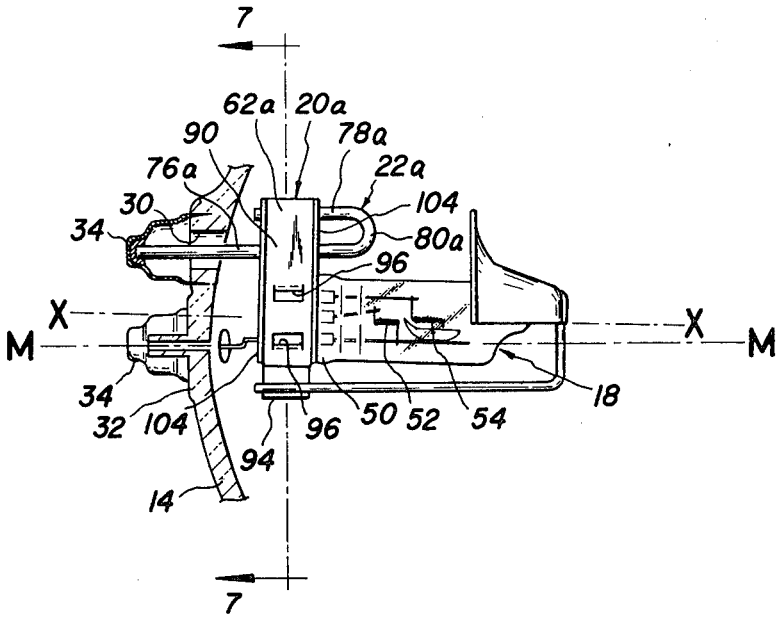
FIG. 6 is an enlarged side elevational view, partly in section, of some essential parts of the headlamp assembly of FIG. 5.

Embodiment of FIGS. 5–7

FIGS. 5, 6 and 7 illustrate a sealed beam headlamp assembly **10*a* of modified construction by way of another preferred embodiment of our invention. The modified headlamp assembly 10*a*** comprises:

1. The hermetically sealed, hard-glass lamp housing 12.
2. The dual-filament halogen lamp 18 within the lamp housing 12.
3. A lamp holder **20*a* of modified construction rigidly holding the halogen lamp 18**.
4. A support rod **22*a* of modified make mechanically and electrically connecting the lamp holder 20*a* to the reflector 14 of the lamp housing 12**.

The lamp housing 12 with its three ferrules 34, and the halogen lamp 18 with its three leads 56, 58 and 60, can both be essentially identical in construction with their counterparts in the preceding embodiment. The description of these components will therefore be omitted.

As shown in detail in FIGS. 6 and 7, the modified lamp holder **20*a* comprises two metal bands 90 and 92 each bent into the approximate shape of an L. The metal bands 90 and 92 have their opposite ends spot-welded to each other to embrace the flat base 50 of the halogen lamp 18 therebetween. The metal band 90 extends upwardly beyond the upper end of the other metal band 92 to provide a fin 62*a*. The lower ends of the metal bands 90 and 92 are held against each other and extend downwardly from the halogen lamp base to provide in combination another fin 94**.

Parts 96 and 98 of the metal bands 90 and 92 are raised inwardly, as by punching, to provide pawls in abutment against the opposite sides of the lamp base 50. The metal bands 90 and 92 also have bosses 100 and 102 projecting inwardly and abutting against the top and bottom, respectively, of the lamp base 50. Thus the lamp holder **20*a* positively engages and holds the halogen lamp 18. The opposite longitudinal sides of the vertical portions of the metal bands 90 and 92 are bent outwardly to provide rims 104 and 106 for reinforcement of the lamp holder 20*a***.

As in the preceding embodiment the support rod **22*a* has its front end portion preformed into the shape of a U to provide a shank 76*a* extending forwardly from the reflector 14 of the lamp housing 12, a fold 78*a* in parallel spaced relationship to the shank, and a bight 80*a* interconnecting the shank and the fold. In this embodiment, however, the fold 78*a* overlies the shank 76*a*; that is, the fold lies on that side of the shank which is away from the halogen lamp 18. The support rod 22*a* has its fold 78*a* spot-welded to the upper fin 62*a* of the lamp holder 20*a*** to serve the purposes noted previously.

FIG. 6 shows that the optical axis X—X of the reflector 14 is inclined approximately two degrees with respect to its mechanical axis M—M, with the optical axis slanting down toward the mechanical axis as it extends forwardly. Thus the optical axis X—X overlies the mechanical axis M—M in the position of the halogen lamp 18. The two coiled filaments of the halogen lamp 18 are aligned along the optical axis X—X. This arrangement, however, is no essential feature of our present invention. The other details of construction can be substantially as set forth above with reference to FIGS. 1–3.

As required, the fold **78*a* and bight 80*a* of the support rod 22*a* may be turned or twisted about its shank 76*a* to bring the fold into abutment against the upper fin 62*a* of the lamp holder 20*a*, as best shown in FIG. 7. The support rod fold 78*a* may then be spot-welded to the lamp holder upper fin 62***a* to support the halogen lamp 18 in position within the lamp housing 12.

Since the support rod fold 78*a* overlies the shank 76*a* in this second embodiment of our invention, a large free space exists in twisting the fold about the shank. The positioning of the halogen lamp 18 on the reflector 14 is therefore easier than in the first embodiment. As an additional advantage the support rod 22*a* can be preformed so as to provide a large spacing between its shank 76*a* and fold 78*a*. This means that the support rod fold 78*a* can be moved a greater distance in the horizontal direction in order to hold the halogen lamp 18 in the required position in spite of a considerable displacement of its filaments from the lamp axis.

It will be seen that the support rod 22*a* lends itself to combination with the lamp holder 20 of FIGS. 1–4 embodiment. The support rod 22 of the preceding embodiment likewise finds use with the lamp holder 20*a* of FIGS. 5–7 embodiment.

Figure 9:
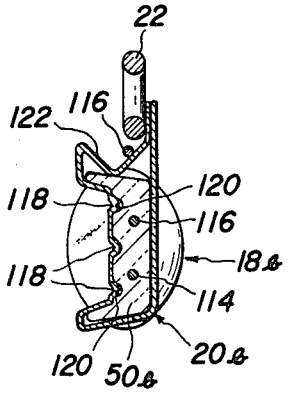
FIG. 9 is a vertical sectional view taken along the line 9—9 of FIG. 8.
Figure 8:
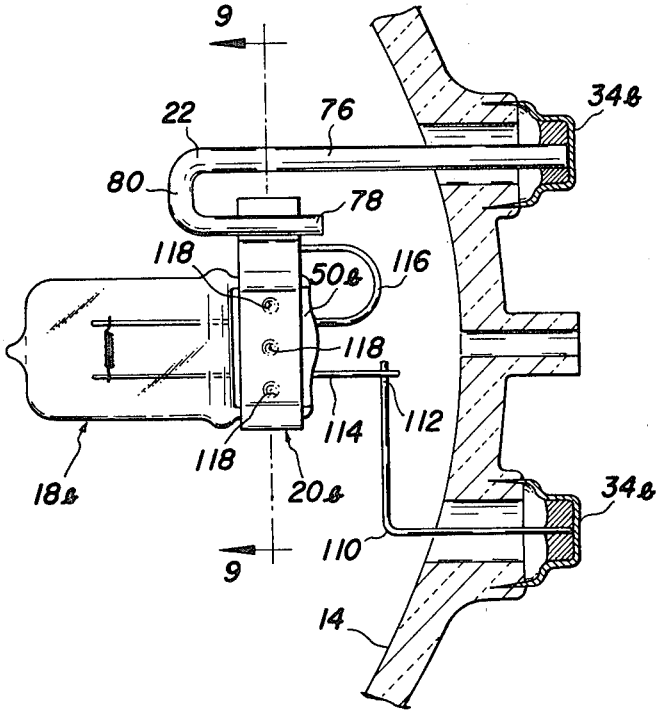
FIG. 8 is a partial side elevational view, partly in section, of still another preferred form of sealed beam headlamp assembly in accordance with our invention.

Embodiment of FIGS. 8 and 9

Although the foregoing embodiments employ dual-filament halogen lamps, our invention is applicable to other types of lamps, as shown by way of example in FIGS. 8 and 9. Representing the most fundamental arrangement in accordance with our invention, this third embodiment comprises:

1. The hermetically sealed, hard-glass lamp housing including the reflector 14.
2. A single-filament incandescent lamp 18*b* within the lamp housing.
3. A lamp holder 20*b* of further modified construction firmly holding the lamp 18*b*.
4. The support rod 22 of exactly the same construction as that of the FIGS. 1–4 embodiment mechanically and electrically connecting the lamp holder 20*b* to the reflector 14.

For use with the single-filament lamp 18*b* the reflector 14 has two ferrules 34*b* affixed to its back. The support rod 22 has its rear end hard-soldered to the upper ferrule 34*b*. Hard-soldered to the lower ferrule 34*b* is one end of a lead extension wire 110, the other end of which is spot-welded at 112 to one (114) of the two lead wires 114 and 116 of the lamp 18*b*.

The lamp holder 20*b* is analogous in construction with the lamp holder 20 of FIGS. 1–4 except that the lamp holder 20*b* has three rounded bosses 118 projecting inwardly. These bosses fit into corresponding depressions 120 formed in one of the opposite sides of the flat base 50*b* of the lamp 18*b*. The lamp holder 20*b* further has a portion 122, just over the lamp base 50*b*, that is bent into the shape of a V. The V-shaped portion 122 is self-biased to press against the top of the lamp base 50*b*, thereby urging the lamp base downwardly against the various parts of the lamp holder capable of bearing such downward thrust of the lamp base. Thus the lamp holder 20*b* firmly holds the lamp 18*b* against any possibility of displacement or dislodgement.

The lamp holder bosses 118 and the lamp base depressions 120 may not necessarily be rounded as shown but may, for example, be rectangular in shape. Regardless of their shape, such depressions should preferably be arranged alternately with the lead wires passing through the lamp base 50*b*.

The lead wire 116 of the lamp 18*b* is bent and spot-welded to the V-shaped portion 122 of the lamp holder 20*b*. The support rod 22 is spot-welded to the fin of the lamp holder, as in all the foregoing embodiments. It is therefore apparent that the support rod 22 permits easy positioning and mounting of the single-filament lamp 18*b* and securely supports the lamp in place in coaction with the lamp holder 20*b*.

Although we have shown and described our invention as adapted for sealed beam headlamp assemblies for motor vehicles, we recognize that our invention is applicable to other types of lamp assemblies comprising a lamp and a reflector. It will also be understood that various changes may be made in the form, details, arrangements, and proportions of the parts of the illustrated lamp assemblies without departing from the scope of our invention as set forth in the appended claims.

We claim:

1. An electric lamp assembly comprising a reflector, a support rod firmly anchored at one end to the reflector and preformed into the shape of a U to include a shank extending forwardly from the reflector and a fold directed rearwardly from the front end of the shank in parallel spaced relation thereto, and, a lamp disposed on that side of the shank which is opposite to the side where the fold lies, the lamp being secured to the fold of the support rod and thereby mounted on the reflector, whereby, the position of the lamp relative to the reflector is preadjusted by turning the fold of the support rod about its shank.

2. The electric lamp assembly as recited in claim 1, further comprising a lamp holder rigidly holding the lamp, the lamp being secured to the fold of the support rod via the lamp holder.

3. An electric lamp assembly comprising a reflector having at least two ferrules mounted thereon, a support rod of electrically conducting material rigidly connected at one end to one of the ferrules in electrically conducting relationship and generally extending forwardly from the reflector, the support rod being preformed to include a U-shaped front end portion having a rearwardly directed fold, a lamp having at least two leads, one of the leads being electrically connected to the other of the ferrules on the reflector, and a lamp holder of electrically conducting material rigidly holding the lamp and electrically connected to the other of the lamp leads, the lamp holder being further rigidly connected to the fold of the support rod in electrically conducting relationship so as to permit adjustment of the position of the lamp relative to the reflector by turning the fold of the support rod about its unbent portion.

4. The electric lamp assembly as recited in claims 2 or 3, wherein the lamp includes a base, and wherein the lamp holder is in the form of a band surrounding the base of the lamp.

5. The electric lamp assembly as recited in claim 4, wherein the lamp holder includes a fin extending away from the base of the lamp, and wherein the fold of the support rod is connected to the fin of the lamp holder.

6. The electric lamp assembly as recited in claim 4, wherein the base of the lamp has at least one depression formed therein, and wherein the lamp holder is formed to include a portion fitting in the depression in the lamp base.

* * * * *